US006247504B1

(12) United States Patent
Vermeulen

(10) Patent No.: US 6,247,504 B1
(45) Date of Patent: Jun. 19, 2001

(54) DEVICE FOR TENSIONING AND DRAWING BACK WARP YARNS COMING FROM A CREEL TO A WEAVING MACHINE

(75) Inventor: Erik Vermeulen, Kortrijk (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/610,535

(22) Filed: Jul. 7, 2000

(30) Foreign Application Priority Data

Jul. 12, 1999 (BE) ..... 09900475

(51) Int. Cl.[7] ..... D03J 1/00; D03D 49/12; D02H 13/26; B65H 59/36

(52) U.S. Cl. ..... 139/97; 28/194; 242/131.1; 139/368

(58) Field of Search ..... 139/353, 97, 110, 139/354, 355, 368; 28/194; 242/131.1

(56) References Cited

U.S. PATENT DOCUMENTS 1,818,526 * 8/1931 Baker ..... 139/97
4,407,331 * 10/1983 Rehling et al. ..... 139/110
5,305,802 * 4/1994 Fehrenbach ..... 139/11
6,016,850 * 1/2000 Zimmermann et al. ..... 139/97

FOREIGN PATENT DOCUMENTS 0 742 297 * 11/1996 (EP) .

* cited by examiner

*Primary Examiner*—Andy Falik
(74) *Attorney, Agent, or Firm*—James Creighton Wray; Meera P. Narasimhan

(57) ABSTRACT

A device for tensioning and drawing back warp yarns brought from a creel to a weaving machine. The tensioning and drawing back device keeps tension and if necessary draws back warp yarns (2) led from a bobbin (1) to a weaving machine. A supporting body (6) has a curved friction surface to support the warp yarn (2) between the bobbin (1) and the weaving machine. A first (7) and a second tensioning element (8) exert a tensile force on the warp yarn (2), respectively, in front of and behind the curved friction surface (6). The tensioning elements (7), (8) can be suspended from the warp yarn (2) and for example only through their own weight may exert this tensile force. This device easily draws back the warp yarn (2) out of the weaving area. The replacement of a bobbin (1) occurs without interruption or disturbance of the weaving process.

21 Claims, 2 Drawing Sheets

DEVICE FOR TENSIONING AND DRAWING BACK WARP YARNS COMING FROM A CREEL TO A WEAVING MACHINE

BACKGROUND OF THE INVENTION

This invention relates to a tensioning and drawing-back device provided for keeping under tension and if necessary drawing back at least one warp yarn led from a bobbin to a weaving machine.

More especially this invention relates to a device which is provided for tensioning and drawing back several warp yarns coming from respective bobbins on a creel to a weaving machine.

These types of devices are generally known and have among others an important application with jacquard weaving machines with different yarn consumption for each individual warp yarn.

Known tensioning and drawing-back devices are for example provided on a creel disposed behind the weaving machine for tensioning and drawing back the warp yarns which during the weaving process are led from the bobbins on this creel to the weaving machine. A creel supports a great number of bobbins or packages. The various warp yarns which are required for weaving a fabric are led from respective bobbins via a number of guiding grids to the weaving machine. In order to prevent these warp yarns from entangling together they must continuously be held under tension. Slack warp yarns in the weaving area must also be absolutely avoided because they adversely affect the fabric quality. They can for example result in an irregular pile formation. In particular warp yarns which on weaving occupy different successive positions in the shed must be capable of being drawn back out of the weaving area in order to keep them under tension.

In a known embodiment each warp yarn unwound from a bobbin is first passed around a guiding spindle disposed behind this bobbin and subsequently brought over the bobbin and a guiding spindle disposed in front of the bobbin. A first and a second drop wire are suspended from the warp yarn, respectively between the bobbin and the rear guiding spindle and between the bobbin and the front guiding spindle, so that these drop wires can press the interjacent piece of warp yarn, which extends above the bobbin, onto the bobbin and in so doing can form a type of band brake on the winding surface of this bobbin. This occurs if the warp yarn is slack.

If the warp yarn tightens during the weaving process, whereby the drop wires are raised, the warp yarn comes into a position whereby it is no longer in contact with the winding surface of the bobbin, so that the braking effect is terminated. Through the further unwinding of the warp yarn the tension can fall away, so that the warp yarn again comes to hang slack. Through the downward movement of the front drop wire the warp yarn is again tensioned and if necessary drawn back out of the weaving area.

A creel provided with such a tensioning and drawing-back device has the disadvantage that the drawing-back effect achieved by the drop wires is dependent on the location of the bobbin in the creel. A drop wire with a bobbin placed at the rear in the creel will have much less effect than one and the same drop wire with a bobbin placed at the front in the creel. The number of points of friction between the drop wire and the weaving area is indeed much greater for the warp yarn which is unwound from the rearmost bobbin.

Another significant disadvantage of this known device is that the replacement of a bobbin is a rather difficult and time-consuming work.

In the European patent application EP 0 742 297 a tensioning and drawing-back device has been described which can be disposed independently of the bobbins and detached from the creel. Each warp yarn is led through a feed-through eye of a strip. This strip is provided capable of sliding up and down in a holder and exerts a tensile force on the warp yarn between two guiding grids. The tensile force is implemented by the own weight of the strip or by means of a retracting spring connected to the strip and a fixed point of the device. Through this tensile force the warp yarn is tensioned and if necessary drawn back out of the weaving area.

Such a device can be disposed at the front in the creel. The replacement of an empty bobbin is easier and less time-consuming with this device than with the above described device. Furthermore in this manner a drawing-back force is achieved which is independent of the location of the bobbin in the creel.

In order to prevent the warp yarns from being pulled out of both the weaving area and from the bobbin to the strip, through which the warp yarn would not be drawn back out of the weaving area in an effective manner and fabrics of less good quality would be woven, with this device, along the side of the bobbin, between the first guiding grid and the bobbin, a leaf spring brake is provided in order to retain the warp yarn. Since tensioning and drawing-back devices are generally implemented for rather large numbers of warp yarns this makes the device much more complex and expensive.

With the embodiments with retracting spring the disadvantage furthermore also exists that the warp yarn tension with the passage of time is subject to too much change through extension of the retracting springs.

SUMMARY OF THE INVENTION

It is a purpose of this invention to provide an effective operational tensioning and drawing-back device which does not have the above mentioned disadvantages, and which enables an easy replacement of a bobbin without interruption of the weaving process.

This objective is according to this invention achieved with a tensioning and drawing-back device with the characteristics mentioned in the first paragraph of this specification, which comprises a supporting body with a curved friction surface in order to support the warp yarn between the bobbin and the weaving machine, and comprises a first and a second tensioning element which exert a tensile force on the warp yarn respectively in front of and behind the curved friction surface.

This tensile force can for example be implemented through the own weight of the tensioning elements and/or through spring elements connected to these tensioning elements.

In the preceding paragraph and in that which follows the use of the words "in front of" and "behind" and the words "first" and "second" is accepted as the direction of view of the direction of movement of the warp yarn led to the weaving machine.

This device works as follows. The warp yarn is pulled on both sides of the friction surface by the tensioning elements into an almost V-shaped path and in so doing the warp yarn is held under tension both in the weaving area and in the section between the friction surface and the bobbin. During weaving the warp yarn is pulled toward the weaving area. Because of this the warp yarn, at least in the V-path behind the friction surface, is moved against the tensile force exerted thereon. This decreases the angle of contact of the warp yarn over the curved friction surface. At the moment that this angle of contact has become so small that insufficient frictional resistance is exerted on the warp yarn in order still to prevent the warp yarn from being fed from the bobbin, the bobbin comes with a jerk to a rotary movement and the warp yarn is unwound. Through inertia of the bobbin often a little too much of the warp yarn is unwound. Because of this the warp yarn under influence of the tensile force exerted thereon will be moved back in the opposite direction until the angle of contact is again great enough to develop a counteracting friction, through which the unwinding from the bobbin ceases. The drawing-back out of the weaving area for compensation of the different positions in the shed occurs by slight upward and downward movements of the warp yarn in the V-path behind the friction surface.

This device works very well and can draw back the warp yarn out of the weaving area better than the known devices. Furthermore this device can be made with simple means and for a relatively low price. Because of the fact that the warp yarn is also held well tensioned in the section between the bobbin and the friction surface, the replacement of a bobbin can occur without interruption or disturbance of the weaving process. This replacement is furthermore also much easier than with the known devices where in the creel, in front of and behind each bobbin a drop wire with a certain weight has been provided.

In a particular embodiment the device furthermore comprises yet another friction surface which is disposed in front of the aforesaid curved friction surface, while the first tensioning element between the two friction surfaces exerts a tensile force on the warp yarn.

According to a preferred embodiment of this invention the tensioning elements are suspended from the warp yarn and it is only their own weight that provides the aforesaid tensile force on the warp yarn.

This embodiment is particularly simple and inexpensive. Furthermore, the tensioning elements can experience no resistance at all in the course of their upward and downward movements. The disposition of the device and the replacement of a bobbin is because of this also very simply and fast to perform.

According to a distinctive feature of this invention the tensioning elements are provided for bearing an additional weight. Because of this the tensile force exerted by the tensioning elements can be adapted to the properties of the warp yarn.

In a very preferred embodiment this tensioning and drawing-back device is provided for tensioning and drawing back several warp yarns coming from respective bobbins on a creel to a weaving machine, while the device is implemented as a separate unit, detached from the creel.

If the aforesaid unit is implemented as a separate module to be placed in front of the creel the advantage is obtained that the drawing-back force is independent of the location of the bobbin in the creel. Furthermore this arrangement makes the replacement of a bobbin even easier and faster to perform.

With this embodiment a first and a second tensioning element is preferably provided on each warp yarn. Each friction surface is used for several warp yarns.

In a very practical but nevertheless simple embodiment each tensioning element comprises a feed-through eye for a warp yarn.

In a particularly well-operating embodiment each tensioning element comprises a rotatable guiding spindle for a warp yarn.

With use of these types of tensioning elements the warp yarn experiences very little frictional resistance if it moves forward in relation to the tensioning element. This promotes the proper operation of the device. In particular this contributes to an improvement in the drawing-back of the warp yarn out of the weaving area and therefore of the fabric quality.

These types of tensioning elements provided with a pulley can also advantageously be utilized with tensioning and drawing-back devices which are not implemented according to this invention.

In a very advantageous embodiment each tensioning element comprises a slot, through which at least one guiding rod extends. Because of this the tensioning elements are prevented from oscillation or turning. Preferably two guiding rods are provided.

Furthermore it is also preferable to provide the device with means for detecting a high position of at least one of the tensioning elements, whereby this high position is occupied in case of an over-tension in the warp yarn, and whereby the device is provided in order as a result of this detection to generate a signal and/or act on the control of a weaving machine drive.

In particular it can be ensured that the weaving machine is stopped in case of over-tension in a warp yarn.

The device can also comprise means for detecting a low position of at least one of the tensioning elements, whereby this low position is occupied in case of a warp yarn breakage, and whereby the device is provided in order as a result of this detection to generate a signal and/or act on the control of a weaving machine drive.

In a particularly efficient embodiment at least one guiding rod comprises an electrode and the detection of the aforesaid position(s) of a tensioning element capable of moving up and down on this guiding rod occurs through a contact of the tensioning element with this electrode. For that purpose the slot preferably has at least one terminal edge which extends in a direction which intersects the cross direction of the slot, and which comprises an electrically conductive material for implementing the aforesaid contact.

The device can further also be so implemented that the set-up height of each electrode can be altered in order to adjust the detection position(s).

This device furthermore preferably also comprises a friction unit with a first and a second guiding rod which are disposed with a clearance between one another, while the warp yarn runs between the first and the second guiding rod, whereby the friction unit can be disposed in at least two different positions, and each position produces another angle of contact of the warp yarn around the respective guiding rods so that the frictional resistance which the warp yarn experiences when running through the friction unit is adjustable.

Such a friction unit is constructionally relatively simple and enables a very easy adjustment of the frictional resistance and therefore of the tension in the warp yarns. Such a friction unit can also be utilized together with other tensioning and drawing-back devices.

The device according to this invention can furthermore also comprise a warp yarn brake with two brake rods between which the warp yarn can be pulled through when feeding to the weaving machine, whereby the brake rods are provided in order to drop wire the warp yarn so that this is slowed down in the course of its movement to the weaving machine.

With a very simple and efficient warp yarn brake the brake rods are disposed one above the other, so that the top brake rod can move freely up and down and so that the clamping force is principally produced by the weight of the top brake rod.

The warp yarn can preferably also slide between the brake rods according to the longitudinal direction of these brake rods.

In a most preferred embodiment in the proximity of the bobbin a feed-through element is provided in order to hold the warp yarn centrally on the winding part of the bobbin.

In that which follows a tensioning and drawing-back device according to this invention is described in detail. This specification only serves to clarify further the characteristics of the invention, and to specify further properties and distinctive features thereof, and can therefore not be considered as a restriction on the protection claimed for this invention in the claims of this patent application.

In this specification reference is made by means of reference numbers to the figures attached hereto, of which

DETAILED DESCRIPTION

Figure 1:
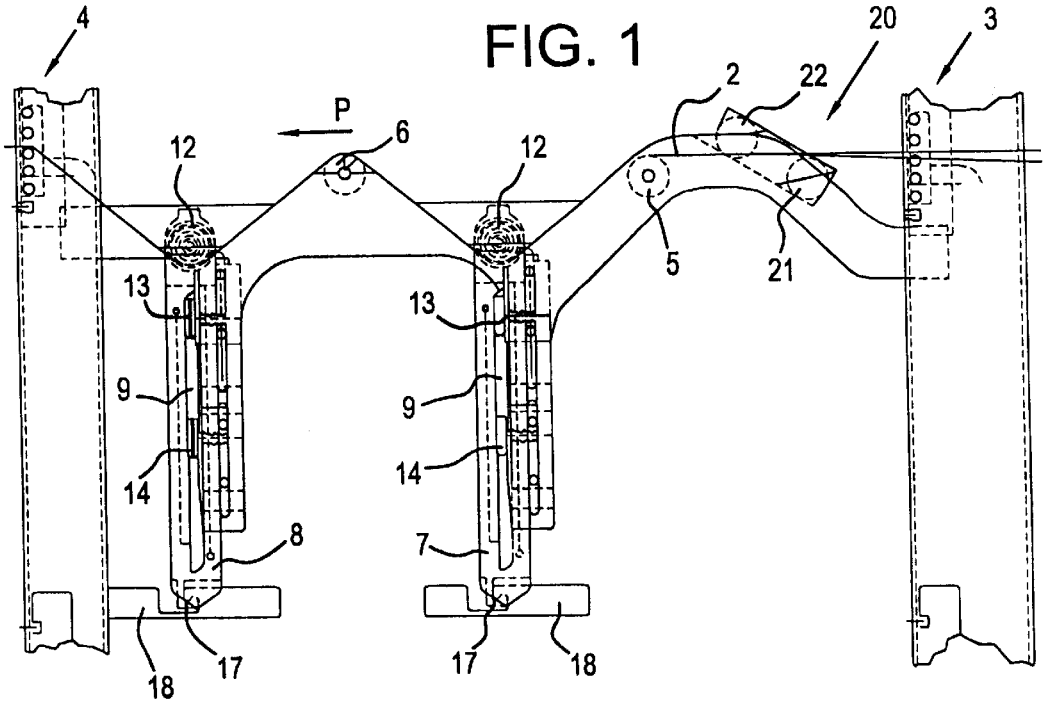
FIG. 1 is a schematic side elevation of a tensioning and drawing-back device according to this invention provided on a creel.
Figure 3:
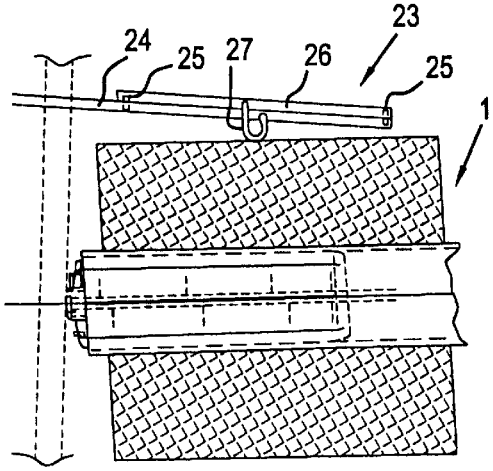
FIG. 3 is a side elevation of a bobbin with a braking device according to this invention.
Figure 4:
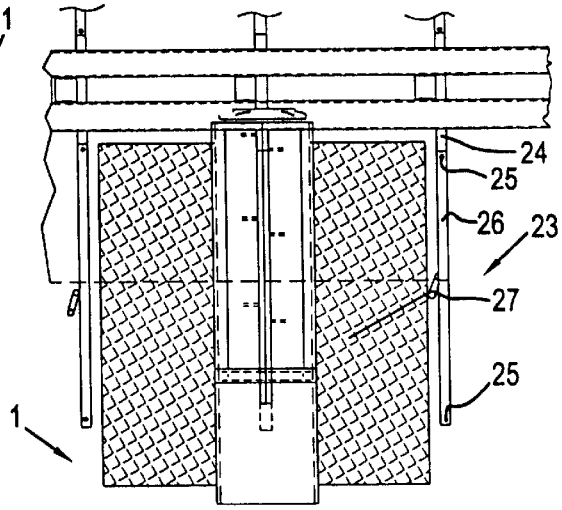
FIG. 4 shows a view from above of the bobbin with braking device represented in FIG. 3.
Figure 2:
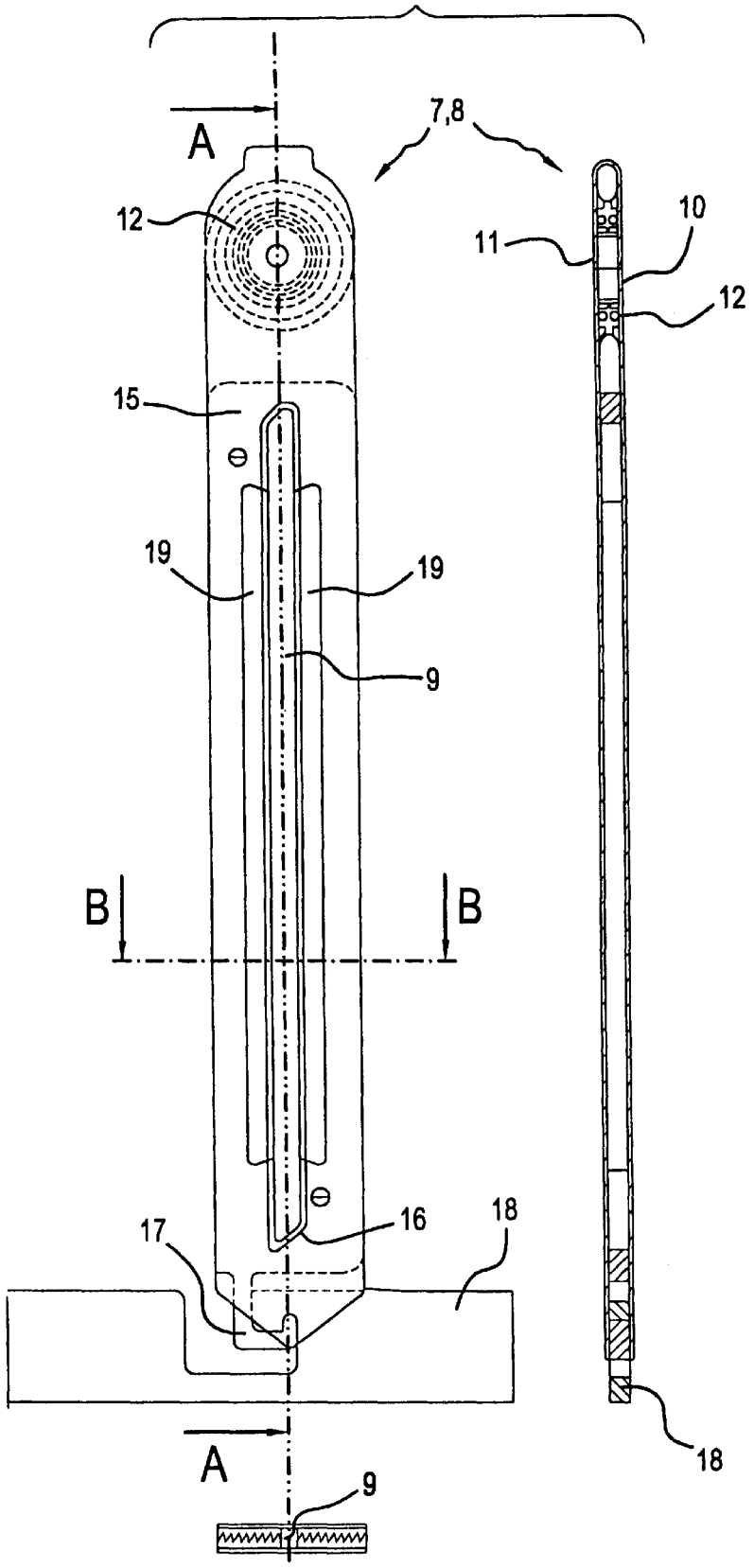
FIG. 2 shows a side elevation, a cross-section according to the axis AA and a cross-section according to the axis BB of a strip of the tensioning and drawing-back device represented in FIG. 1.

A creel disposed with a weaving machine comprises a great number of rotatably disposed bobbins (1), from whereon respective warp yarns (2) are unwound during the weaving process and are led to the weaving machine (as required for weaving), in order there for example to be woven in a fabric as pile warp yarns. The forward movement direction of the warp yarn (2) is indicated in FIG. 1 by means of an arrow (P).

In the front in the creel, at a certain distance apart from each other, a first (3) and a second guiding grid (4) are disposed opposite each other. Each guiding grid principally consists of a number of horizontal rods provided one above the other with interspaces. The warp yarns (2) coming from the bobbins (1) are divided into different layers and the various warp yarns are led through respective interspaces of the guiding grids (3), (4) in order to guide these layers well separated from each other to the weaving machine.

In the section between the guiding grids (3), (4), a first (5) and a second horizontal friction rod (6) are provided in succession (according to the direction of movement (P) of the warp yarn). These friction rods (5), (6) are permanently attached (therefore not rotatable) and at a certain distance apart.

Each warp yarn (2) in this section runs successively (according to the direction of movement (P) of the warp yarn) between two rods of the first guiding grid (3), through a friction frame (20), over the top of the first friction rod (5), over the top of the second friction rod (6), between two rods of the second guiding grid (4), and subsequently to the harness heddles (not represented in the figure) in the weaving area of the weaving machine.

A first strip (7) is suspended from each warp yarn (2) between the two friction rods (5), (6), and a second strip is suspended between the second friction rod (6) and the second guiding grid (4).

The warp yarn (2) is pulled downward through the weight of these strips (7), (8), so that the path of the warp yarn (2), both between the two friction rods (5), (6) and between the second friction rod (6) and the second guiding grid (4) is principally V-shaped.

A strip (7), (8) has an elongated plate-shaped body with a limited thickness and two parallel flat flanks. In this body a slotted hole (9) is provided extending according to the longitudinal axis of the strip and centrally exiting in these flanks.

Each strip (7), (8) has a top part where a gap is left open between two flank plates (10), (11). A rotatable pulley (12) is provided in this gap.

The warp yarn (2) extends through the opening between the aforesaid flank plates (10), (11) and under the pulley (12) of the respective strips (7), (8). The strips (7), (8) consequently rest with their respective pulleys (12) on the warp yarn (2). These pulleys rotate when the warp yarn (2) moves forward toward the weaving machine. The warp yarn (2) consequently experiences a minimum frictional resistance.

These strips function particularly well and can also be used in other devices than the tensioning and drawing-back device described here.

Through the hole (9) of each strip extend two horizontal and parallel guiding rods (13), (14) disposed one above the other. Through the guiding rods the strips are prevented from rotating or oscillating during their upward and downward movements. In this manner the strips (7), (8) exert a very even tensile force on the warp yarn, which results in a very even tension in the warp yarn (2) and a particularly good drawing-back of the warp yarn (2) out of the weaving area.

Each hole (9) has a top (15) and a bottom terminal edge (16) which extends in a direction which forms an acute angle (greater than 0° and less than 90°) with the horizontal cross direction of the hole (9).

The terminal edges (15), (16) of the second strip (8) further also comprise an electrically conductive material in order to be able to make an electric contact with an electrode on the guiding rods (13), (14). The oblique position of the terminal edges (15), (16) ensures a very good electric contact.

If the tension in a warp yarn (2) increases, this second strip (8) is pulled upward. With a specific top threshold value for the tension the bottom terminal edge (16) of the hole (9) will strike against the electrode of the bottom guiding rod (14). As a result thereof this electrode and the conductive material of the bottom terminal edge (16) make an electric contact, through which, via a known electric and/or electronic circuit (e.g. in the same manner as with an electric yarn keeper), a signal is generated which is used as control signal for stopping the weaving machine.

If the tension in a warp yarn (2) decreases the second strip (8) will move downward on the slackening warp yarn (2). When the tension comes under a bottom threshold value (for example in case of a warp yarn breakage) the top terminal edge (15) will come into contact with the electrode on the top guiding rod (13). Because of this an electric contact is made between this electrode and the conductive material of the top terminal edge through which, via a known electric and/or electronic circuit, a signal is generated which is used as control signal for stopping the weaving machine.

The aforesaid electrodes can be disposed at different heights, so that the detection positions of the strips (8), and therefore also the top and the bottom threshold values for the warp yarn tension are adjustable.

Each strip (7), (8) is provided at the bottom with a hook (17) on which an additional weight (18) (e.g. 25 g) can be hung. In this manner the force exerted by the strips (7), (8) can be altered, for example in order to adjust these to specific characteristics (thickness, flexibility, . . . ) of the warp yarn (2).

The strips can be made entirely of metal but can also be implemented in synthetic material. In this latter case they are preferably provided with a so-called metal weight strip in order to obtain a strip with the required weight (e.g. 75 g, 100 g, 200 g (grams), . . . ).

The slot (9) has a guide (19) of synthetic material on both long sides, so that the friction on the guiding rods (13, 14) is kept as low as possible.

The device further also still comprises a friction frame (20) consisting of a framework rotatably disposed between the first guiding grid (3) and the first friction rod (5) in which two rods (21), (22) are attached in succession. The warp yarn (2) runs above the first rod (21) and under the second rod (22). The framework is so disposed that the warp yarn (2) is passed around against the top of the first rod (21) and subsequently against the bottom of the second rod (22). The frictional resistance which the warp yarn (2) experiences when running through this friction frame (20) is dependent on the length of the warp yarn parts which are in contact with the rods (21), (22) and therefore on the angles of contact of the warp yarn (2) on the respective rods (21), (22). Through the turning of the framework these angles of contact can be changed. This friction frame (20) therefore enables an adjustment of the frictional resistance which the warp yarn (2) experiences and therefore of the tension of this warp yarn (2).

Finally the device still comprises a braking device (23) for adjusting the warp yarn tension between the bobbin (1) and the friction frame (20). This braking device (13) comprises a bottom cylindrical rod (24) which is secured to the bobbin chassis and which has two upright pins (25) along the top. The distance between these pins (25) is almost equal to the stroke length of the winding part of the bobbin (1). The warp yarn (2) is brought between the two pins over this bottom rod (24). The upright pins (25) sit with a little play in respective bores of a top rod (26), so that the top rod (24) can move up and down in relation to the bottom rod (24) and can easily be removed from this bottom rod (23).

The weight of the top rod (26) presses on the warp yarn (2) and causes a certain braking of the forward-moving warp yarn (2). The warp yarn (2) is in other words pulled through between top (26) and the bottom rod (24) when unwinding from on the bobbin (1). The warp yarn can also slide sideways (according to the longitudinal direction of the rods (25), (26) between the rods (25), (26) and in this manner follow the windings on the bobbin. This sliding is limited by the upright pins (24). An open feed-through hook is attached to the top rod (26). If the warp yarn (2) to be unwound is led through this hook (27) the warp yarn (2) is held centrally on the winding part of the bobbin (1).

What is claimed is:

1. Apparatus for keeping tension and drawing back warp yarns comprising a bobbin, a weaving machine, at least one warp yarn leading from the bobbin to the weaving machine, a supporting body, a curved friction surface on the body for supporting the warp yarn between the bobbin and the weaving machine, first and second tensioning elements for exerting a tensile force on the warp yarn, the tensile force being exerted on portions of the warp yarn on opposite sides of the curved friction surface.

2. The apparatus of claim 1, further comprising a second friction surface in front of the curved friction surface, wherein the first tensioning element is positioned between the curved friction surface and the second friction surface for exerting the tensile force on the warp yarn.

3. The apparatus of claim 1, wherein the tensioning elements are suspended from the warp yarn, and wherein the tensioning elements are of sufficient weight to exert the tensile force on the warp yarn.

4. The apparatus of claim 3, wherein the tensioning elements further comprise additional weights.

5. The apparatus of claim 1, wherein the tensioning elements tension and drawback plural warp yarns from respective plural bobbins on a creel to the weaving machine, and wherein the apparatus is adopted to be a unit independent from the creel.

6. The apparatus of claim 5, wherein the unit is a separate module adopted to be positioned in front of the creel.

7. The apparatus of claim 1, wherein each tensioning element further comprises a feed-through eye for the warp yarn.

8. The apparatus of claim 1, wherein each tensioning element further comprises a rotatable pulley for the warp yarn.

9. The apparatus of claim 1, wherein each tensioning element further comprises a slot and at least one guiding rod extending through the slot.

10. The apparatus of claim 9, wherein at least one guiding rod further comprises an electrode for detecting high and low positions of each tensioning element, the tensioning elements being movable up and down on the guiding rod, wherein the high and low positions are determinable through contacting of the tensioning element with the electrode.

11. The apparatus of claim 10, wherein the slot further comprises at least one terminal edge extending in a direction forming an acute angle with a cross direction of the slot, and an electrically conductive material in the edge for facilitating the contacting of the tensioning elements.

12. The apparatus of claim 10, wherein the electrode is adapted for altering set-up heights of the electrode thereby detecting positions of the tensioning elements at different adjustable heights.

13. The apparatus of claim 1, further comprising a detector for detecting a high position of at least one of the first and second tensioning elements during an over-tension in the warp yarn and generating signals responsive to a detection of the high-position.

14. The apparatus of claim 13, further comprising a control for a communicating with a weaving machine drive and with the detector, and wherein the signals generated by the detector act on the control of the weaving machine drive.

15. The apparatus of claim 1, further comprising a detector for detecting a low position of at least one of the first and second tensioning elements for detecting a warp yarn breakage or a low tension in the warp yarn and for generating signals responsive to a detection of the low tension or the warp breakage.

16. The apparatus of claim 15, further comprising a control for communicating with a weaving machine drive and with the detector, and wherein the signals act on the control of the weaving machine drive.

17. The apparatus of claim 1, further comprising a friction unit having first and second guiding rods disposed with a clearance between one another, wherein the warp yarn runs between the first and the second guiding rods, the friction unit being adapted for positioning in at least two different positions, wherein each position changes an angle of contact of the warp yarn around respective guiding rods for adjusting a frictional resistance of the warp yarn running through the friction unit.

18. The apparatus of claim 1, further comprising a warp yarn brake having two brake rods for pulling the warp yarn between the two brake rods while feeding the warp yarn to the weaving machine, and wherein the brake rods control speed of the warp yarn for slowing down a movement of the warp yarn being fed to the weaving machine.

19. The apparatus of claim 18, wherein the brake rods are disposed one above the other, wherein the top brake rod is adapted to move freely up and down and wherein a clamping force is principally produced by a weight of the top brake rod.

20. The apparatus of claim 18, wherein the brake rods are longitudinally positioned for the warp yarn to slide therebetween.

21. The apparatus of claim 1, further comprising a feed-through element proximal to the bobbin for holding the warp yarn centrally on a winding part of the bobbin.

* * * * *